US007537513B2

(12) United States Patent
Wadephul

(10) Patent No.: US 7,537,513 B2
(45) Date of Patent: May 26, 2009

(54) DEVICE FOR ACCELERATING ABRASIVES

(76) Inventor: Jost Wadephul, Ketzendorfer Grund 23, D-21614 Bustehude (DE)

( * ) Notice: Subject to any disclaimer, the term of this patent is extended or adjusted under 35 U.S.C. 154(b) by 1380 days.

(21) Appl. No.: 10/110,806

(22) PCT Filed: Aug. 13, 2001

(86) PCT No.: PCT/EP01/09355

§ 371 (c)(1),
(2), (4) Date: Apr. 15, 2002

(87) PCT Pub. No.: WO02/14017

PCT Pub. Date: Feb. 21, 2002

(65) Prior Publication Data

US 2002/0155796 A1 Oct. 24, 2002

(51) Int. Cl.
*B24C 5/00* (2006.01)

(52) U.S. Cl. ..... 451/91; 451/75; 451/94; 451/96; 451/97

(58) Field of Classification Search ..... 451/75, 451/91, 94, 96, 97, 99
See application file for complete search history.

(56) References Cited

U.S. PATENT DOCUMENTS 2,363,437 A 11/1944 Peterson
4,249,350 A * 2/1981 Goff ..... 451/97
4,723,379 A * 2/1988 Macmillan et al. ..... 451/97

* cited by examiner

*Primary Examiner*—Joseph J. Hail, III
*Assistant Examiner*—Shantese McDonald
(74) *Attorney, Agent, or Firm*—Robert W. Becker & Assoc.; Robert W. Becker

(57) ABSTRACT

The invention relates to a device for accelerating abrasives, comprising a centrifugal wheel (8) that is driven to rotate about an axis of rotation. Said centrifugal wheel further comprises blades (2) that are disposed in a substantially radial orientation relative to the axis of rotation, and a lateral disk (4) on which the blades (2) are retained with a lateral edge. A feed line (6) for the abrasive has an opening (7) that is contiguous with the free edges of the blades (2) of the centrifugal wheel (8) outside the axis of rotation of said centrifugal wheel (8). The inventive device is further characterized in that the blades (2), on the side facing the feed line (6), have recesses (3) that are opposite the opening (7) of the feed line (6).

11 Claims, 2 Drawing Sheets

DEVICE FOR ACCELERATING ABRASIVES

BACKGROUND OF THE INVENTION

The present invention relates to an apparatus for accelerating abrasive material with an impeller rotatably drivable about a rotation axis and comprising blades extending substantially radially to the rotation axis and a lateral disk to which the blades are connected along their side edges, as well as at least one feed line for feeding abrasive material, the outlet end of the feed line being at a spacing from the rotation axis of the impeller and bordering on the free side edges of the blades of the impeller.

In a known apparatus of this type described in U.S. Pat. No. 2,363,437, the abrasive material is fed into the working region of the blades of the impeller from the side. The blades are, in this connection, connected along a respective side edge to the lateral disk on which the drive elements of the impeller operate, while the other or free side edge of the blade passes by the outlet opening of the feed line for the abrasive material as the impeller rotates. This type of feeding-in of the abrasive material to the impeller can lead to damage, especially of its blades, if the fed-in abrasive material comprises large debris such as nuts or bolts, as the passage of the blades by the outlet opening of the feed line creates a "pinch angle" which is smaller, or, respectively, less, than such debris pieces. Furthermore, during the passage of the blades by the outlet opening, the inlet flow of the abrasive material into the impeller is interrupted for a short time.

In another known apparatus, disclosed in DD 265 847 A1, the abrasive material is fed into the impeller at the region at which the ends of the blades border on the hub. For this reason, the outlet opening of the feed line, which is formed as a sloped channel, extends into the working region of the blades, which themselves have correspondingly formed inner ends for passage by the outlet opening of the feed line. This manner of feeding-in the abrasive material into the interior of the impeller exhibits the same disadvantages as occur in connection with the known apparatus disclosed in U.S. Pat. No. 2,363,437, in that the passage of the blades by the channel-type outlet opening of the feed line creates, in any event, a "pinch angle".

The challenge of the present invention is to provide an apparatus for accelerating abrasive material to which can be fed abrasive material comprising foreign objects which are larger than the abrasive material, without causing break damage of the impeller.

SUMMARY OF THE INVENTION

This challenge is solved by the inventive apparatus of the heretofore-described type in that the blades exhibit, on the sides thereof facing the feed channel, recesses which are in opposition to the outlet opening of the feed line.

With the cutouts or recesses, in accordance with the present invention, in the blades of the impeller in opposition to the feed line for the abrasive material, a region is created in which, during the passage of the blades by the outlet opening or, respectively, the mouth, of the feed line, the axial and lateral feeding-in of the abrasive material is not interrupted and, at the same time, the unhindered entrance of larger foreign objects into the impeller is made possible.

In a preferred embodiment of the invention, the outlet opening of the feed line extends into the region of the cutouts of the blades in order to optimally feed the abrasive material into the working region of the impeller.

In another, expedient embodiment of the invention, ribs are provided on the outer side of the lateral disk of the impeller which is oriented toward the drive side of the impeller. By virtue of these ribs, abrasive material fed to the impeller into the space between the impeller and the housing arranged in surrounding relation thereto is accelerated radially outwardly so that a sealing element between the housing and the drive shaft of the impeller can be dispensed with.

Further advantageous embodiments of the invention are set forth in the dependent claims.

BRIEF DESCRIPTION OF THE DRAWINGS

An embodiment of the invention is described hereinafter in connection with the drawings. These drawings show.

DESCRIPTION OF THE PREFERRED EMBODIMENTS

Figure 1:
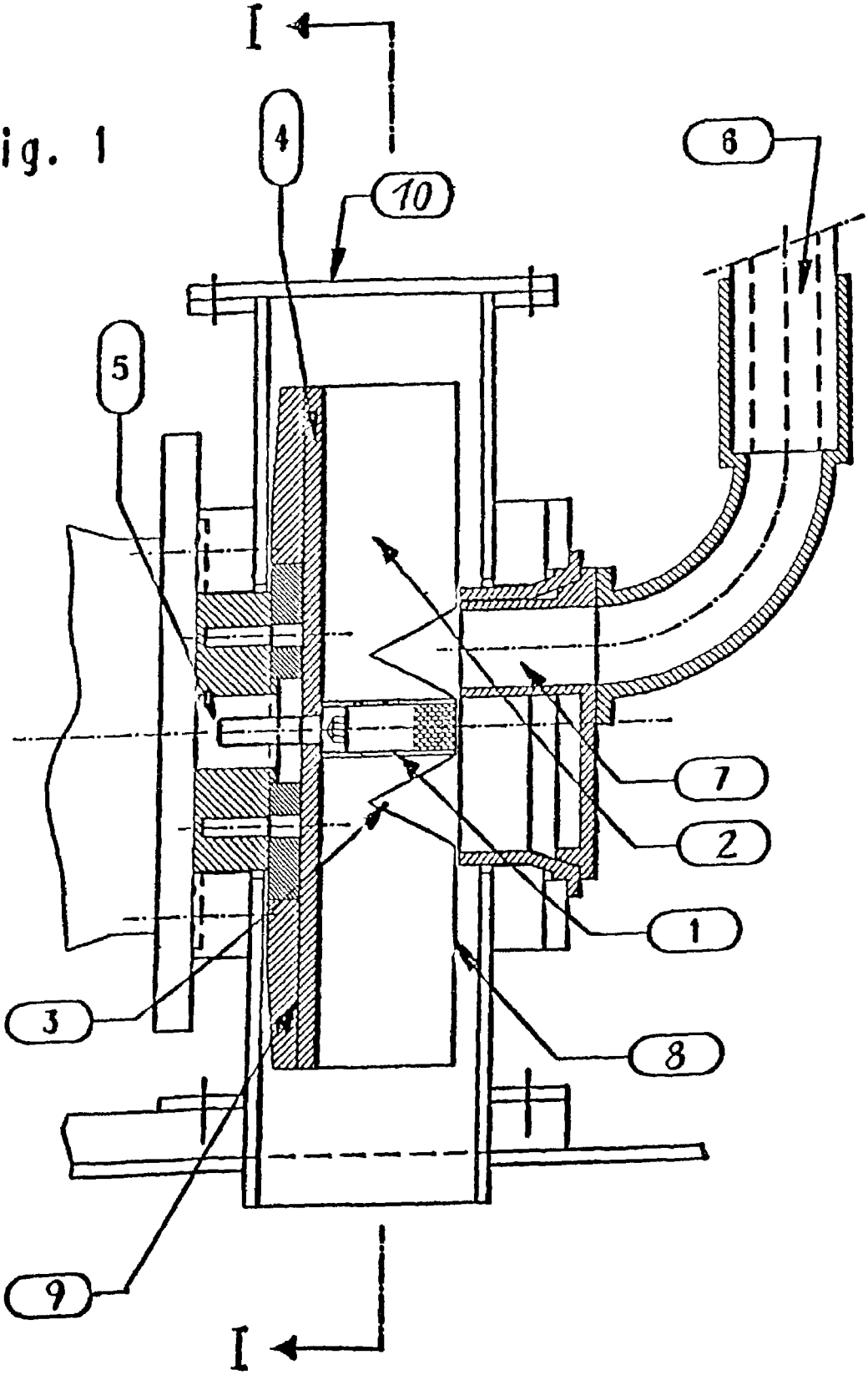
FIG. 1: a schematic sectional view taken through an impeller, which is arranged in a housing.
Figure 2:
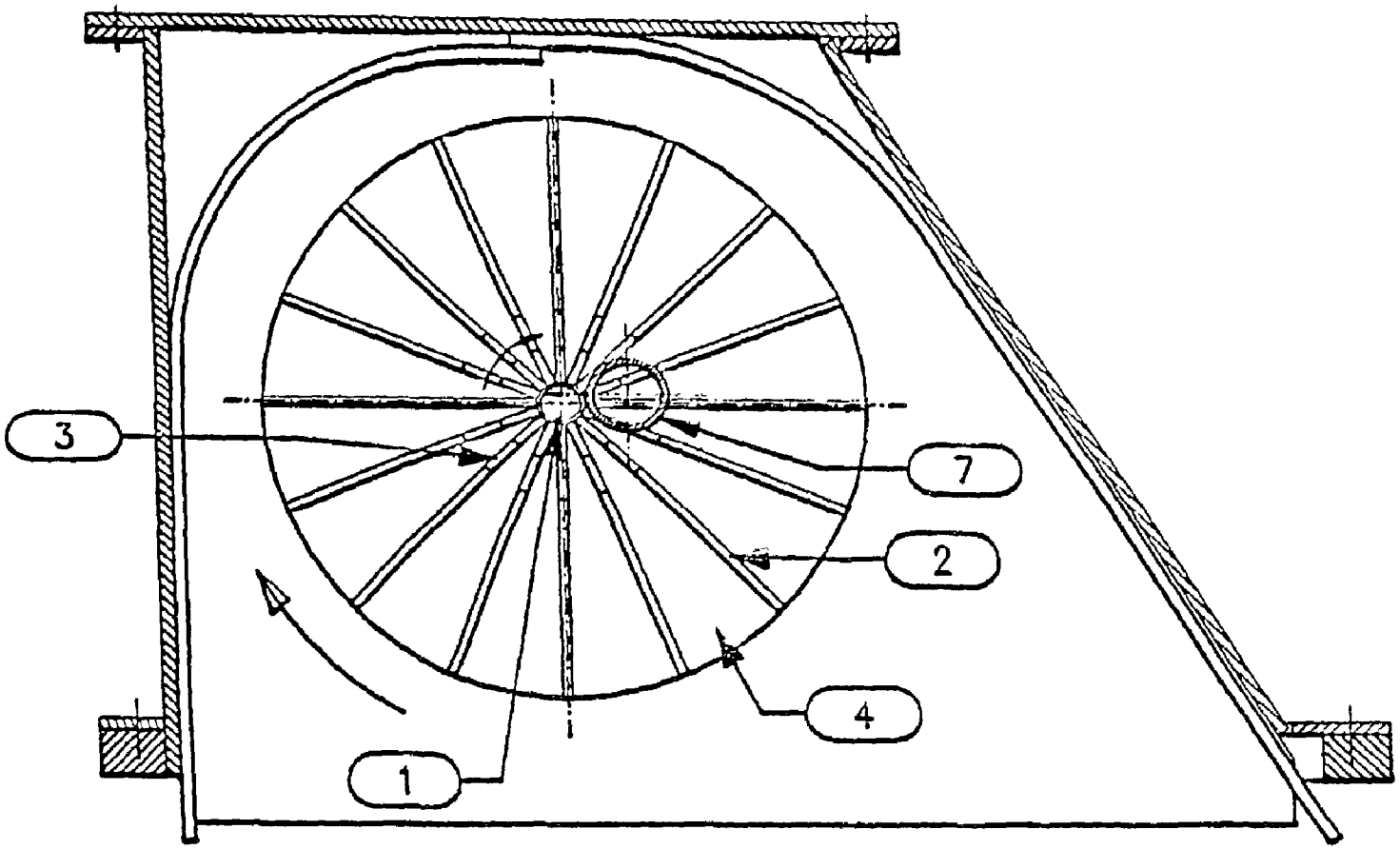
FIG. 2: a schematic sectional view taken through the impeller and the housing in FIG. 1 along the line I-I.

The impeller 8 shown in FIGS. 1 and 2 is enclosed in a housing 10 into which is communicated a feed line 6 via which abrasive materials such as quartz sand and scrap iron are fed to the centrifugal wheel or impeller 8. The drive shaft 5 of the impeller 8 extends out of the housing 10 in a direction in opposition to the feed-in side at which the abrasive material is fed into the impeller.

The impeller 8 comprises a lateral disk 4 which is secured to a drive shaft 5 and carries, on the side thereof, opposite to the side facing the drive shaft 5, blades 2 whose inner ends border on a tube-shaped rotating body 1. The rotating body 1, which forms the hub of the impeller, is disposed centrally of the impeller 8 and is connected in a non-rotating manner to the drive shaft 5 or, respectively, to the lateral disk 4. The feed line 6 communicates into the housing 10 radially to the side of the rotation body 1, the outlet opening 7 of the feed line bordering on the free side edges of the blades 2 of the impeller 8. Cut-outs or recesses 3 are formed in the blades 2 and are in opposition to or across from the outlet opening 7.

Additional ribs 9 are formed on that surface of the lateral disk 4 which is on the opposite side of the lateral disk from the side to which the blades 2 are attached to the lateral disk.

In addition to the afore-described embodiment, other configurations or embodiments are available to one of skill in the art. Thus, in particular, the outlet opening 7 of the feed line 6 can extend into the cut-outs 3 of the blades 2. The cut-outs 3 can also be formed with a curvature, whereby the curvature can be provided with a projection which can extend radially outwardly from the center of the impeller 8 over the outlet opening 7 of the feed line 6.

The specification incorporates by reference the disclosure of German priority document DE 200 14 303.4 filed 15 Aug. 2000.

The present invention is, of course, in no way restricted to the specific disclosure of the specification and drawings, but also encompasses any modifications within the scope of the appended claims.

The invention claimed is:

1. An apparatus for accelerating abrasive material, comprising:

an impeller rotatably drivable about a rotation axis and comprising blades extending substantially radially to the rotation axis, and a lateral disk, each blade having a rear side edge on one axial side thereof and a free side edge on the opposite axial side thereof, and the lateral disk being mounted to the rear side edges of the blades; and at least one feed line for feeding abrasive material into contact with the rotating impeller, the feed line having an outlet end located at a radial spacing from the rotation axis of the impeller, the free side edges of the blades of the impeller moving cyclically angularly past the outlet opening of the feed line, and the blades having cut-outs formed in their free side edges extending axially toward their rear side edges, the cut-out in each blade being at least partially co-incident with the outlet opening of the feed line as the blade moves cyclically angularly past the outlet opening.

2. An apparatus according to claim 1, wherein the blades are comprised of at least two sections in the radial direction.

3. An apparatus according to claim 2, wherein the individual sections of each blade are at a spacing to one another which forms the cut-out.

4. An apparatus according to claim 2, wherein the respective sections of the blades which border on a hub of the impeller are mounted on a separate component of the impeller.

5. An apparatus according to claim 2, wherein the number of sections comprised in the blades is variable.

6. An apparatus according to claim 1, wherein the outlet opening of the feed line extends into the path of the cut-outs of the blades.

7. An apparatus according to claim 1, wherein the blades of the impeller have varying lengths.

8. An apparatus according to claim 1, wherein the inner ends of the blades are in contact against a hub of the impeller in a gap-free manner.

9. An apparatus according to claim 1, wherein the length extents of the blades deviate from a radial orientation relative to the impeller.

10. An apparatus according to claim 1, wherein the lateral disk is an annular disk secured to the free side edges of the blades and a central bore of the annular disk has a radius greater than the radial distance between the radially outermost point of the outlet opening of the feed line and the rotation axis of the impeller.

11. An apparatus according to claim 1 and further comprising ribs on the outer side of the lateral disk of the impeller which is oriented toward the side of the impeller at which a rotation drive mechanism is located.

* * * * *